United States Patent [19]

Noville et al.

[11] Patent Number: 4,744,226

[45] Date of Patent: May 17, 1988

[54] APPARATUS FOR COOLING A METAL PRODUCT IN MOTION

[75] Inventors: Jean-Francois Noville, Liers Herstal; Stéphan Wilmotte, Ninane-Chaudfontaine, both of Belgium

[73] Assignee: Centre de Recherches Metallurgiques-Centrum voor Research in de Metallurgie, Brussels, Belgium

[21] Appl. No.: 10,621

[22] Filed: Feb. 4, 1987

[30] Foreign Application Priority Data

Feb. 5, 1986 [BE] Belgium ..... 6/48188

[51] Int. Cl.[4] ..... F25D 17/02

[52] U.S. Cl. ..... 62/374

[58] Field of Search ..... 62/63, 64, 374, 375, 62/380

[56] References Cited

U.S. PATENT DOCUMENTS

| | | | |
|---|---|---|---|
| 3,405,531 | 10/1968 | Davis, Jr. et al. | 62/374 |
| 3,777,988 | 12/1973 | Thompson | 62/374 |
| 3,844,135 | 10/1974 | Zamiara | 62/375 |
| 4,439,990 | 4/1984 | LeLeoux | 62/375 |
| 4,497,180 | 2/1985 | Graham | 62/374 |
| 4,610,144 | 9/1986 | Lawson | 62/374 |

FOREIGN PATENT DOCUMENTS

| | | |
|---|---|---|
| 900784 | 4/1985 | Belgium . |
| 2547416 | 5/1976 | Fed. Rep. of Germany . |
| 2096490 | 10/1982 | United Kingdom . |
| 2161102 | 1/1986 | United Kingdom . |

*Primary Examiner*—Ronald C. Capossela

*Attorney, Agent, or Firm*—Holman & Stern

[57] ABSTRACT

An upper transverse chamber and a lower transverse chamber have apertures for the passage of cooling agent to a product passing between them. At least the upper chamber is divided into a central compartment corresponding to the central zone of the product, and two lateral compartments, corresponding respectively to the two edge zones of the product. The division into compartments is achieved by partitions which are perpendicular to the bottom of the upper chamber. The partitions form, inside of the upper chamber, a channel converging in the direction of motion of the product.

5 Claims, 1 Drawing Sheet

APPARATUS FOR COOLING A METAL PRODUCT IN MOTION

BACKGROUND TO THE INVENTION

1. Field of the Invention

The present invention relates to apparatus for cooling a metal product in motion. It can be applied in particular to flat products which are very wide, i.e whose width is up to at least 2 m, for example, notably heavy plate.

2. Description of Prior Art

Apparatus for cooling a metal product in motion is already known from Belgian Pat. No. 900 784. That apparatus comprises two transverse perforated chambers which, disposed on either side of the metal product, distribute the cooling agent in a uniform manner over the width of the product to be cooled.

It has, however, been noted that in certain cases it is necessary to be able to vary the water output according to the width of the product, in particular in the case of very wide heavy plate.

This is particularly necessary when the edges are colder than the central portion of the plate before it enters the cooling plant; it is therefore imperative to reduce the water supply on the edges in order to obtain a uniform temperature distribution in the cooled product.

SUMMARY OF THE INVENTION

The object of the present invention is to provide an apparatus which permits the cooling of the product to be adjusted in an appropriate manner in order to avoid the appearance of cold edges after cooling.

The present invention provides a cooling apparatus which comprises an upper transverse chamber, and a lower transverse chamber with respect to the product to be cooled, the chambers being provided with apertures for the passage of the cooling agent to the product, at least the upper chamber is divided into at least three juxtaposed compartments, a first compartment called the central compartment, corresponding to the central zone of the product, and two compartments called lateral compartments, corresponding respectively to the two edge zones of the product, the division into compartments being achieved by partitions which are substantially perpendicular to the bottom of the upper chamber and the partitions being arranged in such a manner as to form, on the inside of the upper chamber, a channel converging toward the front of the chamber, i.e. in the direction of motion of the product.

Preferably, the apertures for the passage of the cooling agent which are housed in the upper chamber are equipped with tubular lengthening pieces on the inside of the chamber which are shorter in length than the internal height of the upper chamber. This set of apertures is divided into at least three groups of apertures by the partitions.

Also, the converging channel preferably has an aperture angle of between 40° and 150°; the converging channel is preferably disposed symmetrically in relation to the longitudinal axis of the product to be cooled.

In a preferred embodiment, each of the compartments is equipped with means to supply it with cooling agent, means of adjustment being also provided in order to vary, preferably separately, the rate of supply of cooling agent to each of the compartments.

The present invention will now be described in detail with reference to a preferred embodiment illustrated by way of example in the accompanying drawing.

DETAILED DESCRIPTION OF PREFERRED EMBODIMENT

Figure 1:
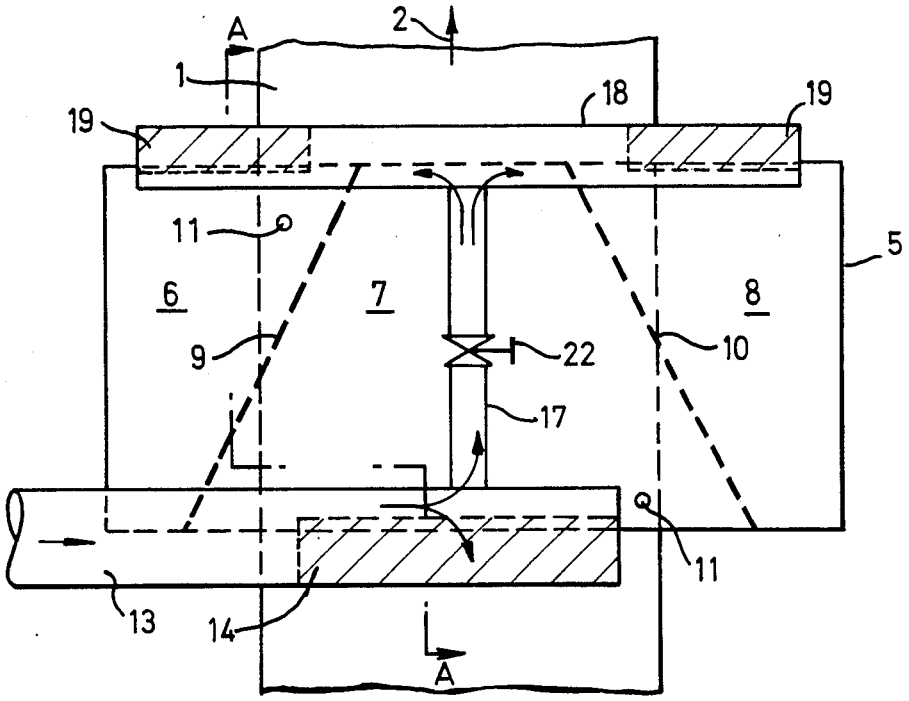
FIG. 1 is a plan view of cooling apparatus according to the invention.

A heavy plate 1 moves in the direction of the arrow 2 on a roller table 3 at the exit of a hot-rolling mill. The plate 1 passes through a cooling apparatus 4 comprising an upper chamber 5 and a lower chamber 23 supplied with cooling agent and arranged in conformity with Belgian Patent No. 900 784. To avoid complicating the drawing unnecessarily, only the upper chamber 5 is shown in detail, since the lower chamber 23 is either unchanged from the prior art or is identical to the upper chamber 5.

Figure 2:
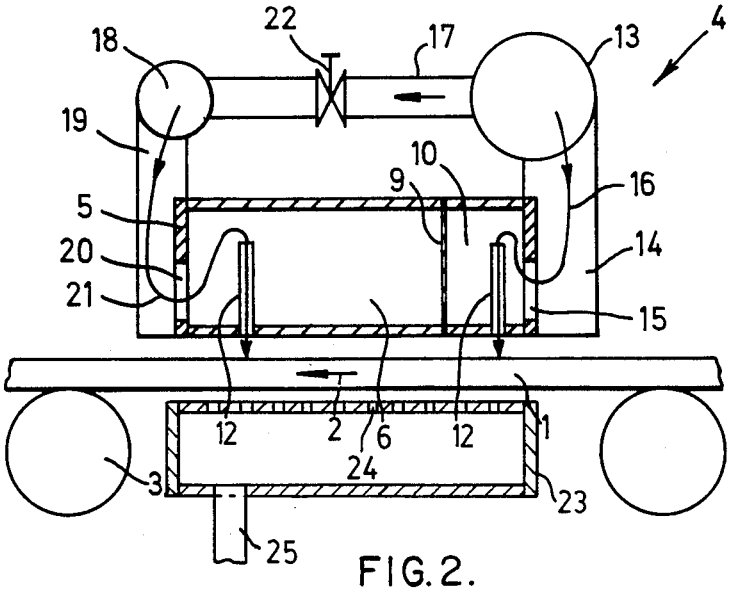
FIG. 2 is a side view in section along the broken line A—A in FIG. 1.

For example, as shown in FIG. 2, lower chamber 23 may be provided with water discharge apertures 24 distributed over the upper wall thereof, be supplied with cooling agent by supply conduit 25, and may correspond in construction with upper chamber 5.

As can be clearly seen in FIG. 1, the chamber 5 is divided into three compartments 6, 7, 8 by means of two vertical partitions 9, 10 which form a channel converging in the direction of motion of the plate. In a manner which is in itself known, the lower wall of the chamber 5, i.e. the one which faces the plate to be cooled, is pierced with outlet apertures which are equipped with tubular lengthening pieces extending inside the chamber 5. By way of illustration, two of these outlet apertures 11 with their tubular lengthening pieces 12, disposed in the compartments 6 and 7 respectively, are represented in FIGS. 1 and 2. It is to be understood that a plurality of such apertures are distributed in an appropriate manner over the bottom of the chamber 5.

The three compartments 5, 7, 8 are juxtaposed, but there is no communication between them. They are supplied separately along the flow circuits of the cooling agent represented schematically in FIG. 1. The main feed pipe 13 is directly connected, via a central pipe 14, to an opening 15 in the rear wall of the central compartment 7. This opening 15 is preferably situated below the level of the entrance aperture of the tubular lengthening pieces 12 with which this compartment 7 is equipped. In FIG. 1, the section of the feed pipe 14 of the central compartment 7 has been shaded in so as to clarify the illustration.

A diversion pipe 17 branches from the main pipe 13 in the direction of a subsidiary pipe 18 which is connected to the lateral compartments 6 and 8 via pipes 19 and openings 20 in the front wall of the chamber 5. In FIG. 1, the traversing section of the feed pipes 19 is also shaded in. The diversion pipe 17 is provided with a valve 22 which permits adjustment of the flow of cooling agent supplied to the compartments 6 and 8.

The drawings illustrate an assembly in which the two compartments 6 and 8 are fed simultaneously from a common source. Obviously, this representation is in no way limiting, and the lateral compartments 6 and 8 could be fed independently of one another from a common source or from separate sources, symmetrically or asymmetrically, without departing from the scope of the present invention.

The apparatus of the invention operates in the following way.

The cooling agent, which is generally water, possibly with suitable additives, is supplied by the main pipe 13. From this pipe, a first portion of the agent reaches the central compartment 7 by passing successively through the pipe 14 and the opening 15. The cooling agent then flows through the tubular lengthening pieces 12 of the central compartment in order eventually to cover the central portion of the upper surface of the product 1 to be cooled. The path of the first portion of the cooling agent is represented by the arrow 16.

At the same time, another portion of cooling agent is guided via the diversion pipe 17 to the subsidiary pipe 18 which supplied the two lateral compartments 6 and 8 via the pipes 19 and the openings 20. The cooling agent flows via the tubular lengthening pieces 12 of the lateral compartments on to the lateral zones or edges of the product 1 to be cooled. The path of this portion of the cooling agent is represented by the arrow 21.

By virtue of the subdivision of the chamber into compartments distributed over the width of the product to be cooled, the apparatus of the invention allows the flow of the cooling agent to be adjusted on the different zones of the surface of the product to be cooled in order to ensure a controlled cooling of the product by avoiding excessive cooling of the edges.

It is possible inter alia to reduce the flow of the cooling agent into the lateral compartments in order to compensate for the cooling effect due to the trickling through of cooling agent from the central compartment.

To this end, the slope of the partitions 9 and 10 with respect to the direction of motion of the product is chosen in relation to the distribution of the apertures 11 in the bottom of the chamber 5 and the flow profiles required over the width of the chamber 5, perpendicular to the direction 2 of motion of the product to be cooled. Under normal conditions, this slope lies advantageously in the range from 20° to 75°.

We claim:

1. An apparatus for cooling a metal product in motion, comprising an upper chamber and a lower chamber, between which the product to be cooled is passed along a path, the upper and lower chambers being arranged transversely with respect to the path of the product, the upper and lower chambers having outlet apertures in respective bottom and top walls thereof for the passage of a cooling agent to the product, at least the upper chamber being provided with partitions dividing at least the upper chamber into at least three juxtaposed compartments including a central compartment corresponding to a central zone of the product, and two lateral compartments corresponding respectively to edge zones of the product, the partitions being substantially perpendicular to the bottom wall of the upper chamber and forming inside of the upper chamber a channel coverging in the direction of motion of the product along said path.

2. The cooling apparatus of claim 1, in which the converging channel has an aperture angle of 40° to 150°.

3. The cooling apparatus of claim 1, in which the central compartment is supplied with cooling agent through an opening in a rear wall of the upper caisson, and the lateral compartments are supplied with cooling agent through openings in a front wall of the upper caisson.

4. The cooling apparatus of claim 3, in which the outlet apertures for the passage of the cooling agent are equipped with tubular lengthening pieces inside their respective compartment, the tubular lengthening pieces extending at least up to the level of the highest point of the supply opening of the respective compartment.

5. An apparatus for cooling a metal product in motion, comprising a roller conveyor for conveying the product to be cooled along a conveyance path, an upper chamber and a lower chamber, said upper and lower chambers being disposed respectively above and under the conveyance path of the product and transversely with respect thereto, said upper and lower chambers having respective bottom and top walls thereof provided with outlet apertures for the passage of a cooling agent to the product, at least said upper chamber having disposed substantially vertically therein partitions extending from the bottom to the top of said chamber so as to divide said chamber into at least three separate compartments juxtaposed along said chamber with respect to said conveyance path of said product, said compartments including a central compartment corresponding to a central zone of the product and two lateral compartments corresponding respectively to lateral edge zones of the product, said partitions being arranged to form inside said chamber a channel converging in the direction of motion of the product along said conveyance path, supply means being provided for separately supplying the cooling agent to each of said compartments, and adjustment means being provided for separately varying the feed rate of the cooling agent to each of said compartments.

* * * * *